US007478462B2

(12) United States Patent
Robert et al.

(10) Patent No.: US 7,478,462 B2
(45) Date of Patent: Jan. 20, 2009

(54) CASKET LID INTERIOR STRUCTURE

(75) Inventors: Pascal Robert, Victoriaville (CA); Rémi Boudreault, Victoriaville (CA)

(73) Assignee: Fournitures Funéraires Victoriaville Inc., Victoriaville, Quebec (CA)

( * ) Notice: Subject to any disclaimer, the term of this patent is extended or adjusted under 35 U.S.C. 154(b) by 464 days.

(21) Appl. No.: 11/230,472

(22) Filed: Sep. 21, 2005

(65) Prior Publication Data

US 2006/0059670 A1 Mar. 23, 2006

Related U.S. Application Data

(60) Provisional application No. 60/611,286, filed on Sep. 21, 2004.

(51) Int. Cl.
*A61G 17/00* (2006.01)

(52) U.S. Cl. ..... 27/19

(58) Field of Classification Search ..... 27/19, 27/2, 14; D99/10

See application file for complete search history.

(56) References Cited

U.S. PATENT DOCUMENTS

| | | | | | |
|---|---|---|---|---|---|
| 2,718,687 | A | * | 9/1955 | Woltering et al. | 27/19 |
| 2,964,824 | A | * | 12/1960 | Hillenbrand | 27/19 |
| 3,077,016 | A | * | 2/1963 | White | 27/19 |
| RE25,545 | E | * | 3/1964 | White | 27/19 |
| 3,316,608 | A | * | 5/1967 | Ross | 27/19 |
| 3,344,494 | A | * | 10/1967 | McClive | 27/19 |
| 3,407,459 | A | * | 10/1968 | Elder | 27/19 |
| 3,835,509 | A | * | 9/1974 | Esterdahl | 27/19 |
| 4,137,613 | A | * | 2/1979 | Ceresko | 27/19 |
| 4,357,741 | A | * | 11/1982 | Winburn et al. | 27/19 |
| 4,868,957 | A | * | 9/1989 | Rojdev | 27/17 |
| 5,495,648 | A | * | 3/1996 | Rojdev et al. | 27/19 |
| 5,634,247 | A | * | 6/1997 | Bowling | 27/19 |
| 5,636,419 | A | * | 6/1997 | Foye | 27/19 |
| 5,675,877 | A | * | 10/1997 | Lewis | 27/19 |
| 6,105,221 | A | * | 8/2000 | Cox | 27/19 |
| 6,151,762 | A | * | 11/2000 | Cox | 27/19 |
| 6,742,231 | B1 | * | 6/2004 | Calhoun et al. | 27/19 |

* cited by examiner

*Primary Examiner*—William L. Miller
(74) *Attorney, Agent, or Firm*—Ogilvy Renault LLP; Dominique Pomerleau

(57) ABSTRACT

A casket lid includes a lid member having an underside and a dish assembly covering a first section of the underside of the lid member. The dish assembly includes a first cover member having a flap and a covering section, the flap being mounted to the lid member and the covering section extending over the flap and the first section of the underside of the lid member. The dish assembly can have a first panel extending over a first section of the underside of the lid member and having a first edge. The casket lid can include an insertion member defining an insertion groove and positioned on one of the underside of the lid member and a second panel of the dish assembly, the first edge of the first panel being inserted into the insertion groove.

24 Claims, 7 Drawing Sheets

CASKET LID INTERIOR STRUCTURE

CROSS-REFERENCE TO RELATED APPLICATIONS

This application claims priority of U.S. provisional patent application 60/611,286 filed on Sep. 21, 2005, the specification of which is hereby incorporated by reference.

BACKGROUND OF THE INVENTION

1) Field of the Invention

The invention relates to burial or cremation caskets and, more particularly, to the interior structure of casket lids.

2) Description of the Prior Art

Caskets or coffins traditionally include a body container to which is pivoted a lid or a cap. During viewing of the deceased in the casket, the cap is pivoted to its open position to permit relatives, loved ones, acquaintances, and the like to view the deceased. During this time the underside of the casket lid is visible. It is thus desirable to trim the underside of the lid with a decorative trim. This is usually accomplished with the installation of a dish assembly into the underside of the cap.

The dish assembly generally includes a center panel surrounded by a frame. The frame portion is commonly referred as "puffing". The term puffing generally describes the raised and curved look of this frame portion.

Casket lids are first manufactured and then a dish assembly is mounted to the underside of the casket lid. In the past, the installation of the dish assembly to the underside of a casket lid has been a relatively difficult, time consuming, and expensive procedure. One of the prior techniques for this task was to fasten the dish assembly on the casket lid with fasteners such as staples and nails and cover the fasteners thereafter with small furnish strips or with any other material known by one skilled in the art.

SUMMARY OF THE INVENTION

It is an object of the present invention to provide a new dish assembly which addresses the above concerns.

It is another object of the invention to provide a method for mounting a dish assembly to the underside of a casket lid which is relatively easy to carry out.

One aspect of the invention provides a casket lid, which comprises: a lid member having an underside; and a dish assembly covering at least a first section of the underside of the lid member, the dish assembly including a first flap and a first covering section, the first flap being mounted to the lid member and the first covering section extending over the first flap and the first section of the underside of the lid member.

Another aspect of the invention provides a casket comprising the casket lid as described above.

Another aspect of the invention provides a casket lid dish assembly adapted to cover at least one portion of an underside of a casket lid. The casket lid dish assembly comprises: a first cover member having an outer flap securable to the casket lid and a covering section extending over the at least one portion of the underside, the outer flap being hidden behind the covering section.

Another aspect of the invention provides a method to cover an undersurface of a casket cap. The method comprises: providing a cap cover assembly including a first cover panel and an outer extension member; mounting the outer extension member to the casket cap; and folding the first cover panel over the outer extension member, the first cover panel extending over the outer extension member and at least a section of the undersurface of the casket cap.

A further aspect of the invention provides a casket lid, which comprises: a lid member having an underside; a dish assembly having a first panel extending over at least a first section of the underside of the lid member and having a first edge; and an insertion member defining an insertion groove and being positioned on one of the underside of the lid member and a second panel of the dish assembly, the first edge of the first panel being inserted into the insertion groove.

Another aspect of the invention provides a method for mounting a dish assembly to a casket lid underside. The method comprises: providing an insertion groove on a first element to be assembled to a first panel of the dish assembly; and inserting a free edge of the first panel into the insertion groove for assembling the first element and the first panel, wherein the first element is one of a second panel of the dish assembly and the casket lid underside.

According to a general aspect, there is provided a casket lid comprising: a lid member having an underside; and a dish assembly covering at least a first section of the underside of the lid member, the dish assembly including a first flap and a first covering section, the first flap being mounted to the lid member and the first covering section extending over the first flap and the first section of the underside of the lid member, the first flap and the first covering section defining a first cover member of the dish assembly, the dish assembly comprises a second cover member covering a second section of the underside, one of the first cover member and the second cover member including an acute angle member defining an acute angle spacing, an edge of the other one of the first cover member and the second cover member being inserted into the acute angle spacing for assembling the first cover member and the second cover member.

According to another general aspect, there is provided a casket lid dish assembly adapted to cover at least one portion of an underside of a casket lid, the casket lid dish assembly comprising: a first cover member having an outer flap securable to the casket lid and a covering section extending over the at least one portion of the underside, the outer flap being hidden behind the covering section and a central panel mounted to an inner flap of the first cover member with the inner flap overlying a section of the central panel and the covering section extending over the assembly formed by the inner flap and the central panel.

According to another general aspect, there is provided a casket lid comprising: a lid member having an underside; a dish assembly having a first panel extending over at least a first section of the underside of the lid member and having a first edge; and an insertion member defining an insertion groove and being positioned on one of the underside of the lid member and a second panel of the dish assembly, the first edge of the first panel being inserted into the insertion groove, the insertion member including an acute angle member extending from a covering section of the second panel and an edge of the second panel is mounted to the underside of the lid member, the covering section of the second panel extending over a section of the underside of the lid member.

According to another general aspect, there is provided a casket lid comprising: a lid member having an underside; a dish assembly covering at least a first section of the underside of the lid member, the dish assembly including a first flap and a first covering section, the first flap being mounted to the lid member and the first covering section extending over the first flap and the first section of the underside of the lid member; and fasteners coupling the first flap and the lid member to mount the dish assembly to the lid member, the fasteners being hidden by the first covering section when the first covering section extends over the first section of the underside of the lid member.

According to still another general aspect, there is provided a casket lid comprising: a lid member having an underside, a cover and a rim at least partly surrounding the cover; and a dish assembly covering at least a first section of the underside of the lid member, the dish assembly including a first flap and a first covering section, the first flap being mounted to the lid member and the first covering section extending over the first flap and the first section of the underside of the lid member, the first flap being mounted to the underside of the rim, the first covering section extending over the first flap and at least partially the rim.

According to a further general aspect, there is provided a casket lid dish assembly adapted to cover at least one portion of an underside of a casket lid, the casket lid dish assembly comprising: a first cover member having an outer flap securable to the casket lid and a covering section extending over the at least one portion of the underside, the outer flap being hidden behind the covering section, the covering section being contiguous to the outer flap, the junction of the outer flap and the covering section defining a living hinge allowing the outer flap and the covering section to define an acute angle when secured to the casket.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
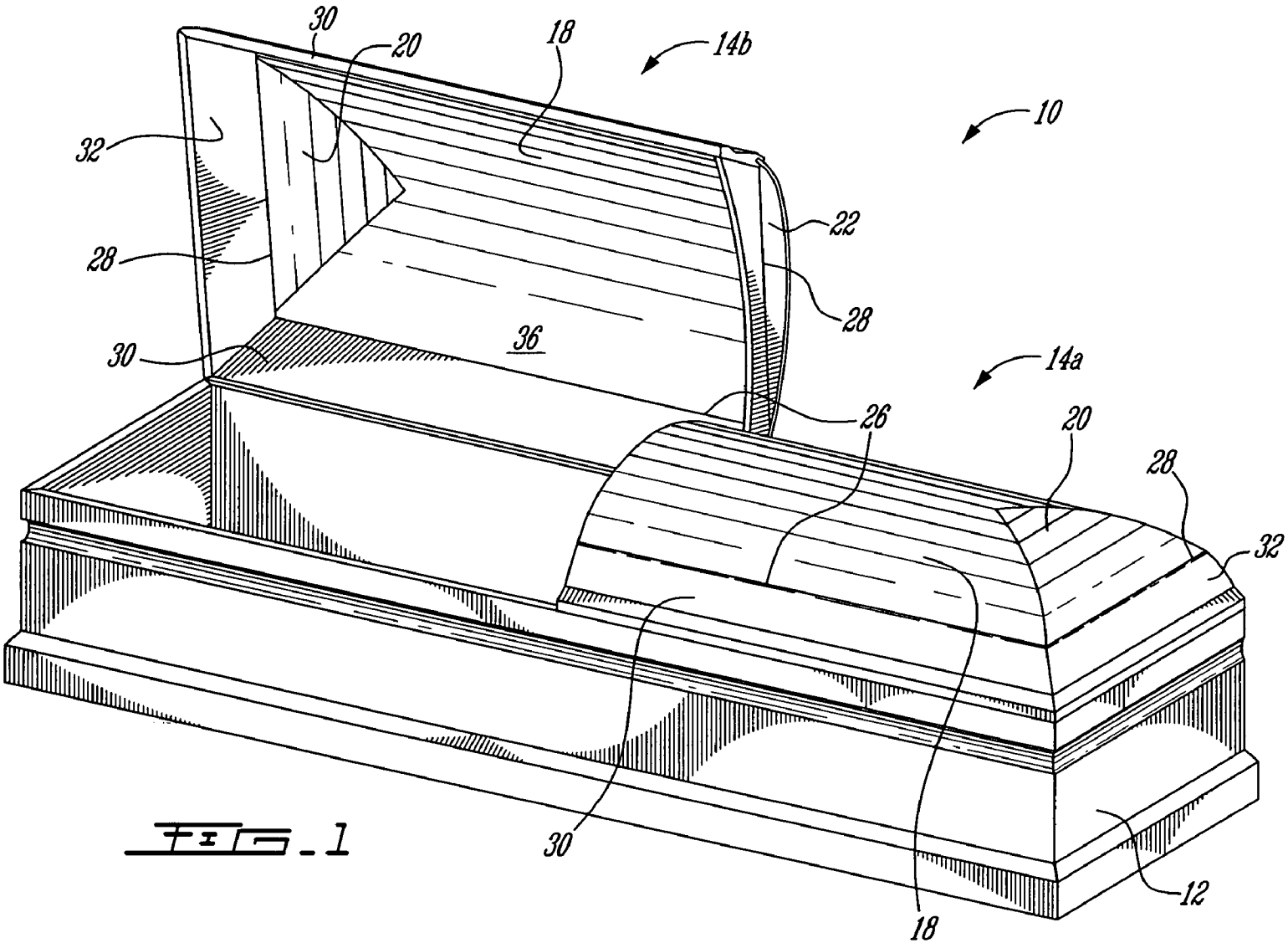
FIG. 1. is a perspective view of a conventional casket having a split lid with a first section shown in a closed position and a second section shown in an open position.

Referring to FIG. 1, it will be seen that a casket 10 has a body container 12 and a lid 14, pivotally mounted to the body container 12. The lid 14 can either be a one-piece lid (not shown) or a split lid having two sections 14*a*, 14*b*. The lid 14 has preferably an arched shape. Each section 14*a*, 14*b* of the split lid has a crown 18, a pie 20, and a header 22 forming a cover having a pair of opposed longitudinal sides 26 and a pair of opposed transversal ends 28. The header 22 is positioned at the transversal end 28 opposed to the pie 20. A longitudinal rim 30 is juxtaposed to each longitudinal side 26 of the cover. A transversal rim 32 is juxtaposed to the transversal end 28 adjacent to the pie 20.

Figure 2:
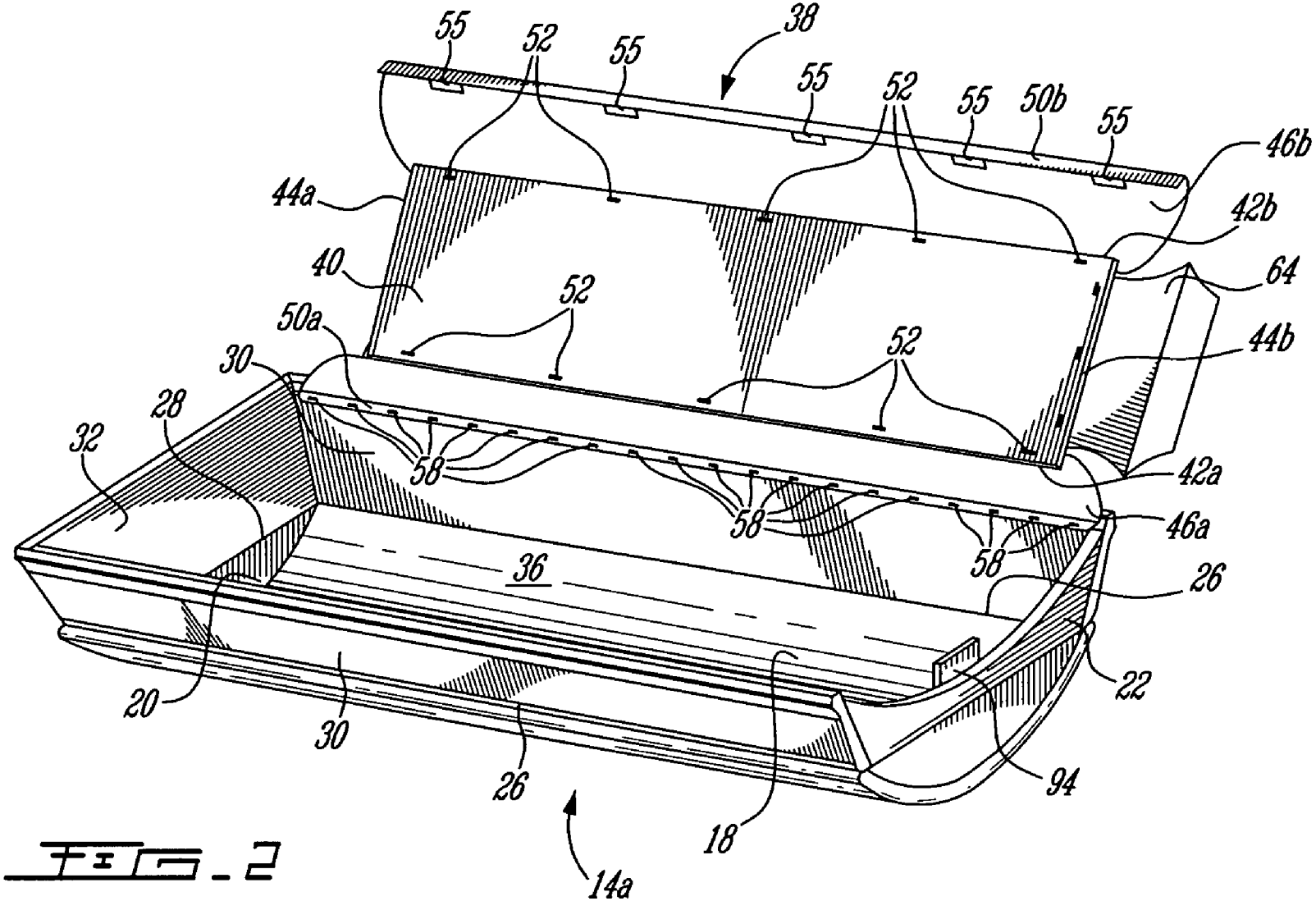
FIG. 2 is a perspective view of one section of the split lid shown in FIG. 1, wherein the split lid includes a first section of a dish assembly in accordance with an embodiment of the present invention, wherein the first section of the dish assembly is partially mounted to the split lid section.

A one-piece lid (not shown) would have a crown and two pies forming the cover with a pair of opposed longitudinal sides and a pair of opposed transversal ends. A longitudinal rim is positioned at each longitudinal side of the cover and a transversal rim is positioned at the each transversal end. Still referring to FIG. 1, it can be seen that the casket lid 14 has an underside 36, which is typically covered for aesthetic purpose. Referring now to FIG. 2, there is shown a dish assembly 38, partially mounted to one section 14*a* of the casket lid 14 for covering its underside 36. The dish assembly 38 will be described for one section 14*a* of the split lid, however one skilled in the art will appreciate that it can easily be applied to a one-piece lid and the other section 14*b* of the split lid.

Figure 4:
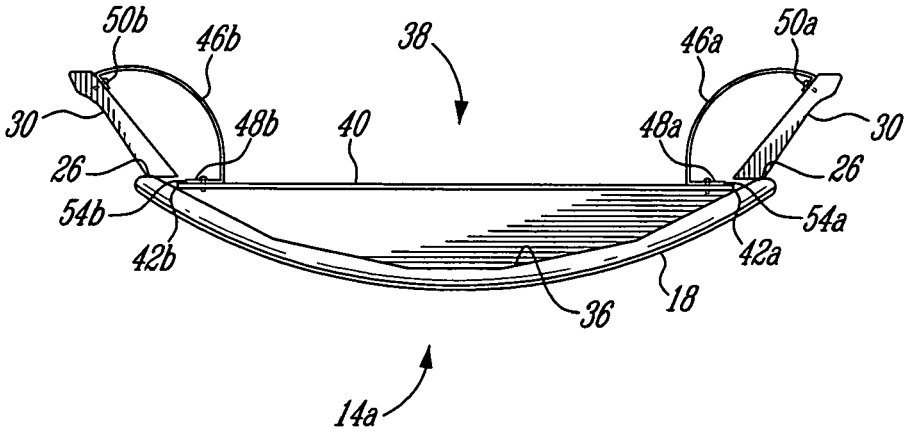
FIG. 4 is a sectional view taken along cross-section lines 44 of FIG. 3 of the section of the split lid with the dish assembly covering transversally the underside of the lid.

The dish assembly 38 includes a central panel 40, having two opposed longitudinal edges 42*a*, 42*b* and two opposed transversal edges 44*a*, 44*b*, and two longitudinal panels 46*a*, 46*b* mounted to a respective longitudinal edge 42 of the central panel 40. Each longitudinal panel 46 has an inner flange 48*a*, 48*b* (FIG. 4) and an outer flange 50*a*, 50*b*. The inner flanges 48*a*, 48*b* are juxtaposed to a respective longitudinal edge 42*a*, 42*b* of the central panel 40. Referring to FIG. 2, it will be seen that the inner flanges 48*a*, 48*b* are mounted to the central panel 40 with staples 52. However, one skilled in the art will appreciate that the central panel 40 and the longitudinal panels 46*a*, 46*b* can be single piece or joined with any appropriate fastener or adhesive. If fasteners such as staples 52 are used to join the central panel 40 and the longitudinal panels 46*a*, 46*b*, the outer edges 54*a*, 54*b* of the inner flanges 48*a*, 48*b* are preferably juxtaposed to the longitudinal edges 42*a*, 42*b* of the central panel 40 in a manner such that the longitudinal panels 46*a*, 46*b* cover the fasteners once the dish assembly 38 is mounted inwardly of the section 14*a* of the casket lid 14 (FIG. 4). The fasteners are thus located between the underside 36 of the casket lid 14 and the dish assembly 38.

Preferably, the central panel 40 and the longitudinal panels 46*a*, 46*b* are assembled before being mounted to the underside 36 of the casket lid 14. However, one skilled in the art will appreciate that they can be assembled while mounting the dish assembly 38 to the underside 36 of the casket lid 14.

In one embodiment, the outer flange 50*a* of the longitudinal panel 46*a* is first mounted to one of the longitudinal rims 30 of the lid 14*a*. Referring simultaneously to FIGS. 2 and 4, it will be seen that the outer flange 50*a* is mounted to the longitudinal rim 30 in a manner such that when the dish assembly 38 is mounted inwardly of the section of the casket lid 14, the outer flange 50*a* and the fasteners used to mount the outer flange 50, if any, are invisible from an outside point of view. The outer flange 50*a* and the fasteners are located between the underside 36 and the longitudinal panel 46*a*. Referring to FIG. 2, there is shown that a plurality of staples 58 are used to mount the outer flange 50*a* on the longitudinal rim 30. One skilled in the art will appreciate that other fasteners such as nails and screws or adhesives can be used.

Figure 3:
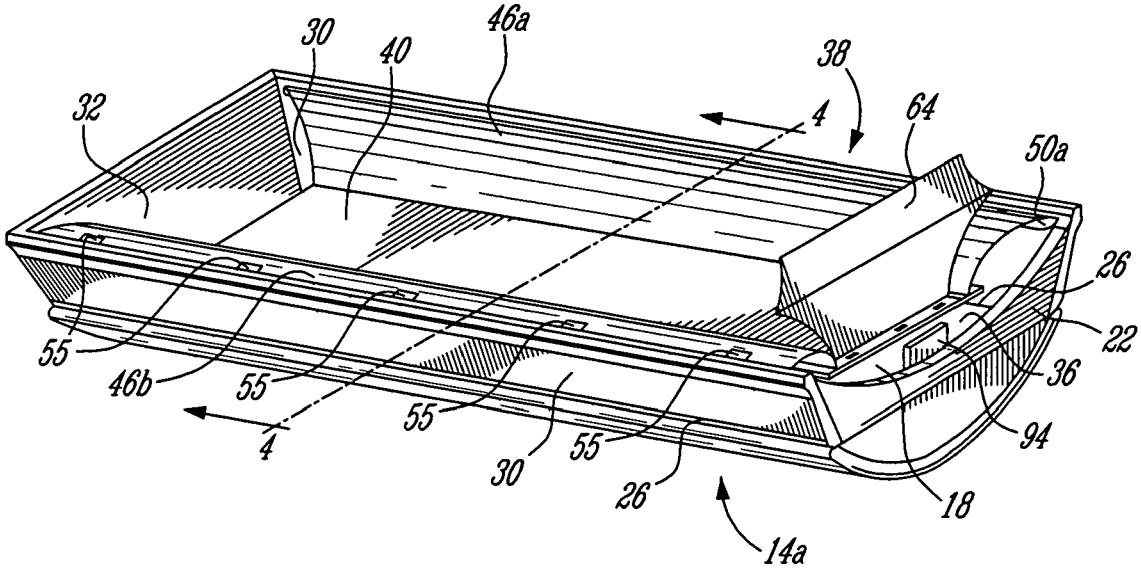
FIG. 3 is a perspective view of the section of the split lid shown in FIG. 2, wherein the dish assembly covers transversally the underside of the lid.

Referring now to FIGS. 3 and 4, it is seen that the outer flange 50*a* is folded inward and is not apparent from the outside. The outer flange 50*a* and the staples 58 are covered by the longitudinal panel 46*a* and are invisible from an outside point of view when the dish assembly 38 is mounted inwardly of the section of the lid 14*a*. The heads of the fasteners 58 are located between the underside 36 of the casket lid 14 and the dish assembly 38.

Figure 5:
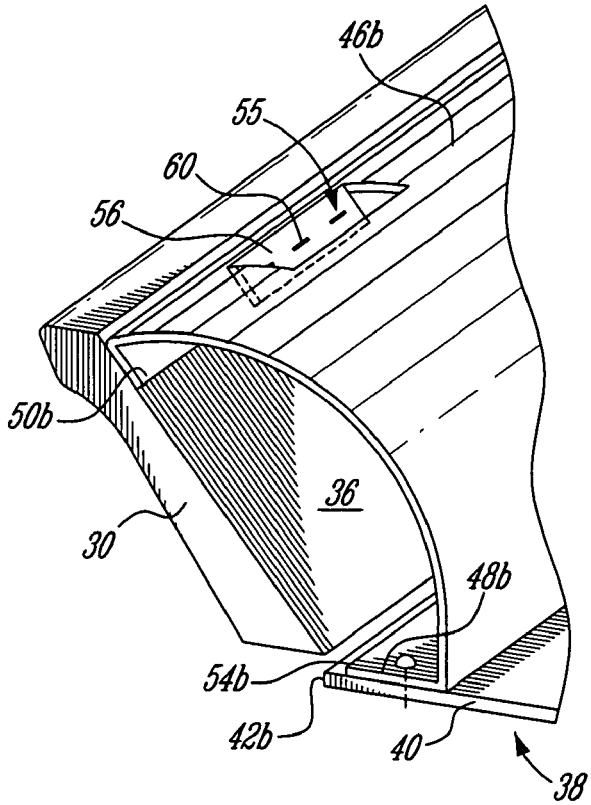
FIG. 5 is a perspective view, fragmented and enlarged, of a longitudinal rim of the casket lid shown in FIG. 3 with the first section of the dish assembly mounted thereto.

Referring back to FIG. 2, it will be seen that the longitudinal panel 46*b* includes a plurality of apertures 55 juxtaposed to the junction of the outer flap 50*b* and the longitudinal panel 46*b*. Referring to FIG. 5, there is shown that the apertures 55 are created by performing only three cuts into the longitudinal panel 46*b*, thereby creating a mounting flap 56 juxtaposed to the junction of the outer flap 50*b* and the longitudinal panel 46*b*. The mounting flap 56, having a live hinge, pivots freely relatively to the outer flap 50*b* and the longitudinal panel 46*b*.

The outer flange 50*b* of the second longitudinal panel 46*b* is juxtaposed to the longitudinal rim 30 of the section of the lid 14*a*. The mounting flaps 56 are pivoted inwardly towards the outer flap 50*b*. Fasteners 60 are inserted simultaneously into the mounting flaps 56 and the outer flap 50*b* to mount the outer flap 50*b* to the longitudinal rim 30. The outer flap 50 is disposed inwardly of the longitudinal panel 46*b*, i.e. between the underside 36 of the longitudinal rim 30 and the longitudinal panel, as shown in FIG. 3. The edge of the second longitudinal panel 46*b*, including the apertures and the fasteners 60 (FIG. 4), can be covered with a furnish strip (not shown) or any other appropriate material.

Referring back to FIG. 2, it will be seen that, for a section 14*a* of a split-lid 14 including a header 22, a header covering assembly 64 is mounted to the transversal edge 44*b* of the central panel 40. The purpose of the header covering assembly 64 is to cover the underside 36 of the header 22 of the casket lid 14*a*, as it will be described in more details below.

Figure 6:
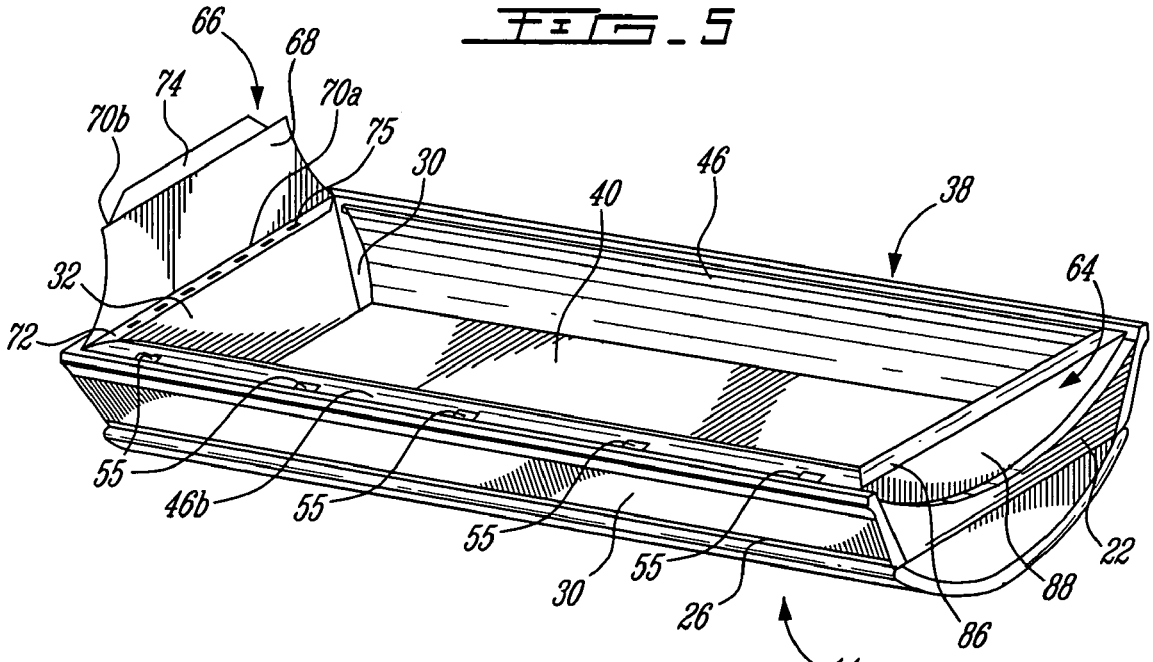
FIG. 6 is a perspective view of the section of the split lid shown in FIG. 2, including the dish assembly shown in FIG. 2, and a second section of the dish assembly in accordance with another embodiment of the present invention, wherein the second section of the dish assembly is partially mounted to cover the underside of a lid pie.

Referring to FIG. 6, there is shown that the dish assembly 38 can also include a pie covering assembly 66 adapted to cover the underside 36 of the pie 20 and the transversal rim 32 of the lid 14*a*. The pie covering assembly 66 includes a panel 68 with two longitudinal edges 70*a*, 70*b* opposite to each other, an outer flange 72 juxtaposed to the first longitudinal edge 70*a*, and an acute angle member 74 juxtaposed to the opposed longitudinal edge 70*b*. The pie covering assembly 66 can be of unitary construction with folding edges or live hinges dividing the outer flange 72, the panel 68 and the acute angle member 74. It can also be formed from multi-pieces assembled together to form the pie covering assembly 66.

Preferably, if the pie covering assembly 66 is formed from multi-pieces assembled together, the multi-pieces are assembled before mounting the pie covering assembly 66 to the casket lid 14*a*. However, one skilled in the art will appreciate that they can be assembled while mounting the pie covering assembly 66 to the casket lid 14*a*.

The outer flange 72 is first mounted to the transversal rim 32 juxtaposed to the pie 20 of a section of the lid 14*a*. The fasteners are inserted simultaneously into the outer flange 72 of the pie covering assembly 66 and the transversal rim 32 of the casket lid 14. The heads of the fasteners, not inserted into the transversal rim 32, are located between the underside 36 and the panel 68 of the pie covering assembly 66 and are not apparent from an outside point of view. The outer flange 72 and the fasteners are located between the underside 36 and the panel 68 as shown in FIG. 6. A plurality of staples 75 are used to mount the outer flange 72 on the transversal rim 32. The panel 68 overlies the outer flange 72 and the staples 75. Therefore, the outer flange 72 and the staples 75 are invisible from an outside point of view. One skilled in the art will appreciate that other fasteners such as nails or screws or an adhesive can be used.

Figure 7:
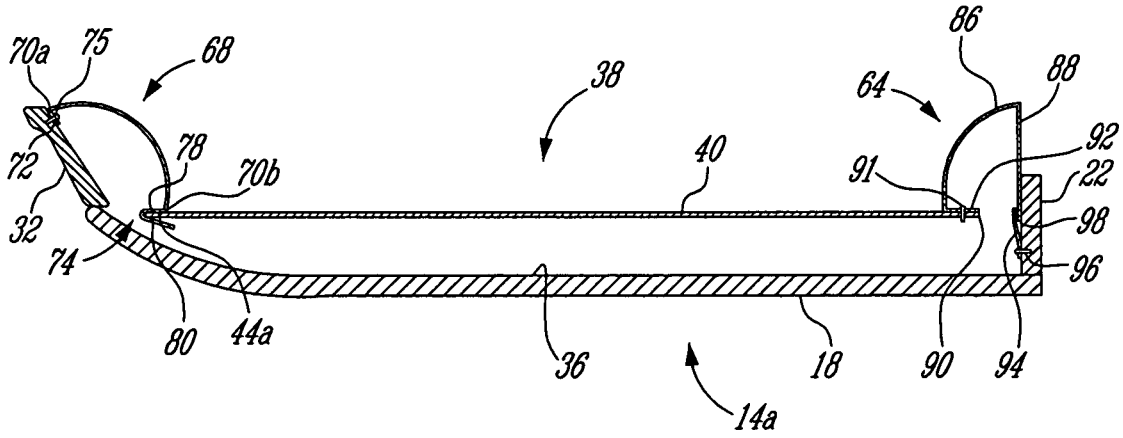
FIG. 7 is a longitudinal cross-sectional view of the section of the split lid including the first and second sections of the dish assembly shown in FIG. 6, wherein the dish assembly covers the pie, the crown, and the header of the lid.

As shown in FIG. 7, the acute angle member 74 has a first member 78 contiguous to the panel 68 and a second member 80 contiguous to the first member 78. The first and second members 78, 80 are maintained in position to form the acute angle with at least one staple 82. However, one skilled in the art will appreciate that the first and second members 78, 80 can be maintained in position to form the acute angle with any other appropriate technique. The transversal edge 44*a* of the central panel 40 is inserted in the acute angle member 74 to mount the pie covering assembly 66 to the central panel 40. For a one-piece lid, the second pie 20 and the second transversal edge 32 is covered in a similar manner than the first pie 20 and the first transversal edge 32.

The outer flange 72 is preferably mounted to the transversal rim 32 before inserting the transversal edge 44*a* of the central panel 40 into the acute angle member 70.

As mentioned above, for a split-lid 14 including a header 22 as shown in FIGS. 6 and 7, one header covering assembly 64 is provided to cover the underside 36 of the header 22. The header covering assembly 64 includes a panel 86, an outer extension 88, and an inner flange 90. As for the pie covering assembly 66, the header covering assembly 64 can be made from a unitary piece of material with folding edges or live hinges dividing the outer extension 88, the panel 86 and the inner flange 90. Alternatively, it can be assembled from several individual pieces.

As for the pie covering assembly 66, if the header covering assembly 64 is formed from multi-pieces assembled together, the multi-pieces are assembled before mounting the header covering assembly 64 to the underside 36 of the casket lid 14*a*. However, one skilled in the art will appreciate that they can be assembled while mounting the header covering assembly 64 to the underside 36 of the casket lid 14*a*.

The inner flange 90 is juxtaposed and mounted to the transversal edge 44*b* of the central panel 40. One skilled in the art will appreciate that the central panel 40 and the header covering assembly 64 can be single piece or joined with any appropriate fastener or adhesive. If fasteners such as staples 91 are used to join the central panel 40 and the header covering assembly 64, the outer edge 92 of the inner flange 90 is preferably juxtaposed to the transversal edge 44*b* of the central panel 40 in a manner such that the panel 86 cover the fasteners 91 once the header covering assembly 64 is mounted inwardly of the section 14*a* of the casket lid 14 (FIG. 4). The fasteners 91 are thus located between the underside 36 of the casket lid 14 and the header covering assembly 64.

Referring to FIGS. 2 and 6, it will be seen that a lip member 94 is secured to the underside 36 of the header 22 and defines an acute angle therewith. The lip member 94 is fastened to the header 22 with a fastener 96 but it will be appreciated that it can be mounted to the header 22 with any other appropriate technique. The outer edge 98 of the outer extension 88 is inserted into the space defined between the lip member 94 and the underside 36 of the header 22, for assembling the header covering assembly 64 to the casket lid 14*a*. No fastener is required to mount the outer extension 88 to the header 22.

As shown in FIG. 2, the inner flange 90 is preferably mounted to the central panel 40 before inserting the outer extension 88 into the acute angle defined between the lip member 94 and the underside 36 of the header 22.

The lip member 94 can include a biasing member (not shown) to apply pressure on the outer extension 88 and firmly maintain the latter between the header 22 and the lip member 94.

Figure 8:
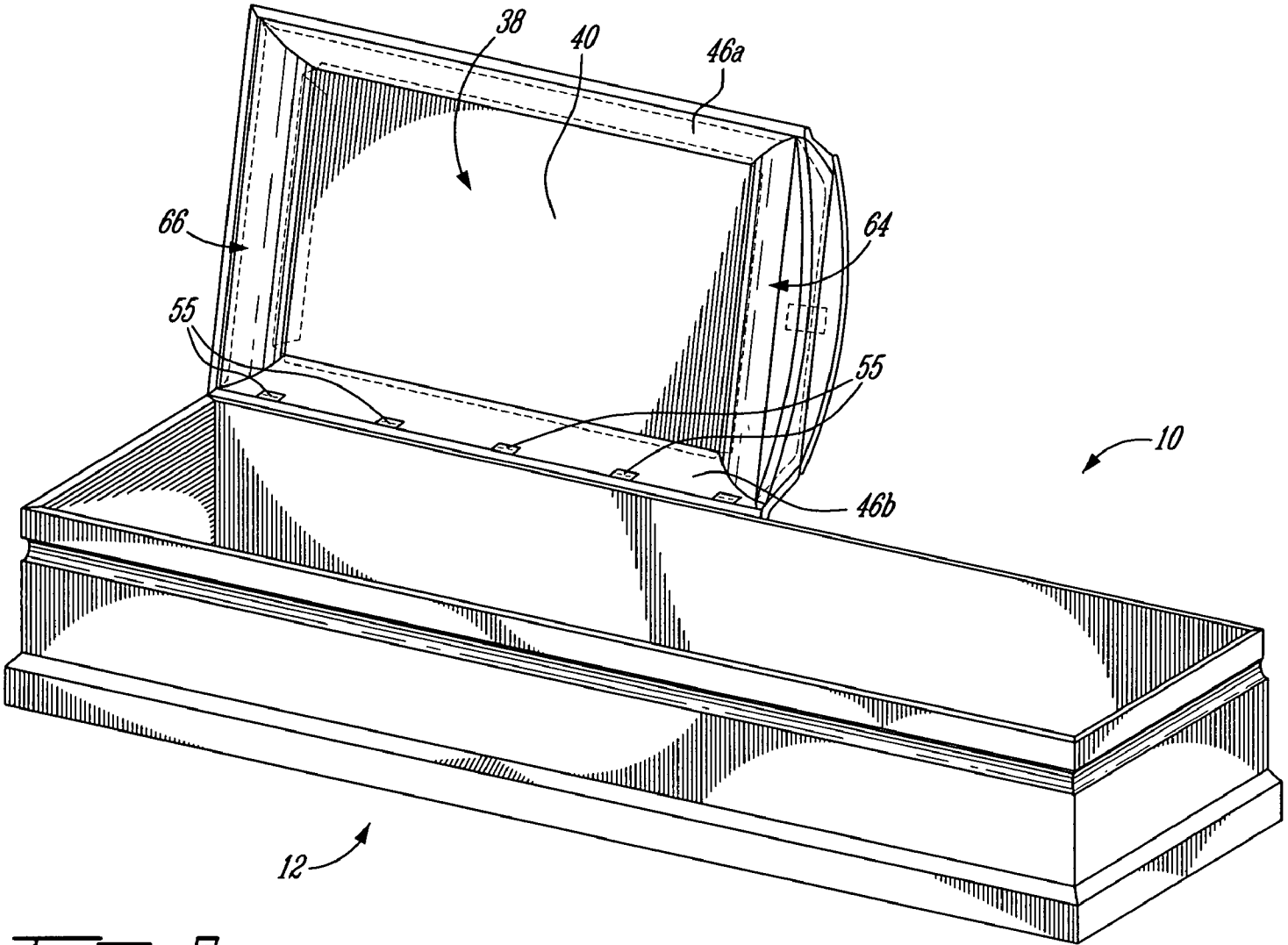
FIG. 8 is a perspective view the conventional split lid casket shown in FIG. 1, including the dish assembly shown in FIG. 7.

Referring now to FIG. 8, there is shown the casket 10 wherein the split lid 14*a* is pivotally mounted thereto. The dish assembly 38, described hereinabove, is mounted to the split lid 14*a* and covers its underside 36. There is shown that fasteners (fasteners 60 in the apertures 55), if any, only appears on one longitudinal rim 30. If desired, a strip (not shown), or a plurality of strips, of any material can be mounted to the longitudinal panel 46*b*, over the apertures 55, to hide the fasteners 58. The other fasteners used to mount the dish assembly 38 to the underside 36 of the lid 14*a* are positioned between dish assembly 38 and the underside 36 and are invisible from an outside point of view.

As shown on FIG. 7, the hinges connecting the body container 12 and the split lid 14*a* are preferably mounted to the longitudinal rim 30 juxtaposed to the longitudinal panel 46*b*. Therefore, the fasteners 60, if any, are more easily masked.

Figure 9:
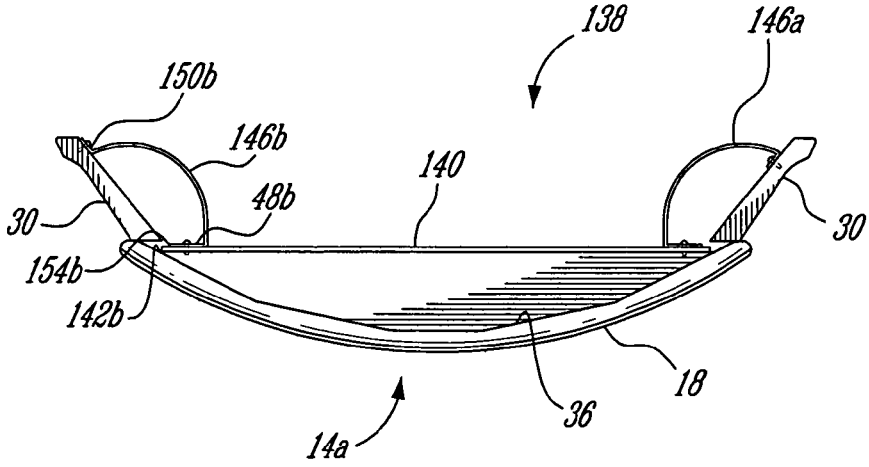
FIG. 9 is a transversal cross-section view of the section of the split lid with a dish assembly in accordance with another embodiment of the present invention.

Referring now to FIG. 9, another embodiment of the dish assembly 38 will be seen wherein the features are numbered with reference numerals in the 100 series which correspond to the reference numerals of the previous embodiment.

The outer flange 150*b* of the longitudinal panel 146*b* is mounted to the longitudinal rim 30 of the section 14*a* or the lid with any appropriate fasteners or adhesive. The outer flange 150*b* is mounted outwardly of the longitudinal panel 146*b* and is not covered by the latter. As for the previous embodiment, the outer flange 150*b* and the fasteners, if any, can be covered with a furnish strip (not shown) or any other appropriate material. It is also possible to use an adhesive to mount the outer flange 150*b* to the longitudinal rim 30. Once again, the hinges connecting the body container 12 and the split lid 14*a* are preferably mounted to the longitudinal rim 30 where the outer flange 150*b* is mounted. Therefore, the fasteners, if any, are more easily masked.

Figure 10:
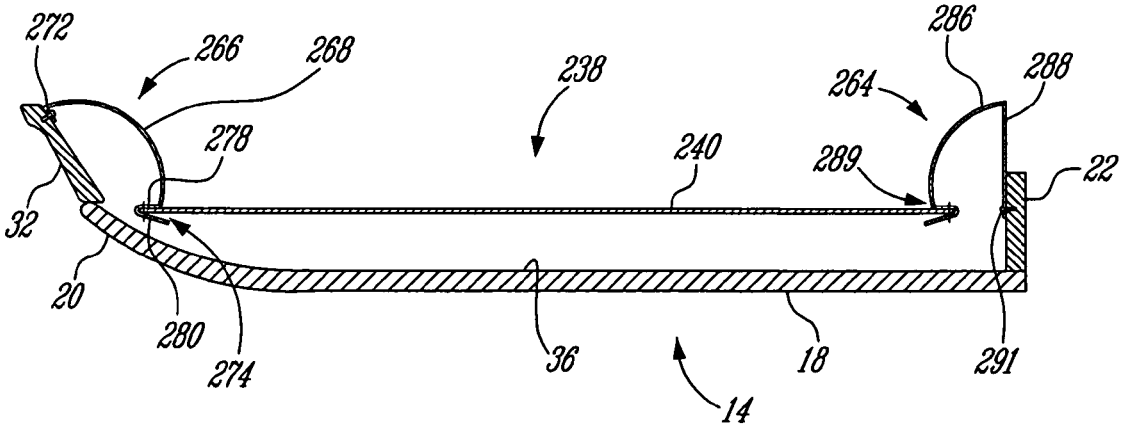
FIG. 10 is a longitudinal cross-section view of the section including a dish assembly in accordance with another embodiment of the present invention.

Referring now to FIG. 10, another embodiment of the dish assembly 38 will be seen wherein the features are numbered with reference numerals in the 200 series which correspond to the reference numerals of the previous embodiment.

The header covering assembly 264 can include a panel 286, an outer extension 288, and an acute angle member 289 similar to the one of the pie covering assembly 66, described above.

As for the pie covering assembly 66, the header covering assembly 264 can be made from a unitary piece of material with folding edges or living hinges dividing the panel 286, the outer extension 288, and the acute angle member 289. Alternatively, it can be assembled from several individual pieces.

As for the pie covering assembly 66, if the header covering assembly 264 is formed from multi-pieces assembled together, the multi-pieces are assembled before mounting the header covering assembly 264 to the underside 36 of the casket lid 14. However, one skilled in the art will appreciate that they can be assembled while mounting the header covering assembly 264 to the underside 36 of the casket lid 14.

The outer extension 288 is mounted to the inside of the header 22 of the lid 14 with appropriate fasteners such as nails or screws or an adhesive. In the embodiment shown on FIG. 10, staples 291 (only one is shown) are used to mount the outer extension 288 to the header 22. The outer extension 288 is juxtaposed to the header 22 and staples 291 are inserted into the outer extension 288 and the header 22. The panel 286 is flipped over the outer extension 288, inside the lid 14, and covers the head of the staples 291. The heads of the staples 291 are positioned between the outer extension 288 and the panel 286. Therefore, the staples 291 are invisible from an outside point of view. The transversal edge 244*b* of the central panel 240 is inserted in the acute angle member 289. As for the pie covering assembly 66, no fastener is required to mount the header covering assembly 264 to the central panel 240.

The outer extension 288 is preferably mounted to the header 22 before inserting the transversal edge 244*b* of the central panel 240 into the acute angle member 289.

As one skilled in the art will appreciate, the dish assembly can differ from the embodiments described hereinabove. For example, the central panel 40 can be securely mounted to the header and pie covering assembles 64, 66, 264 and the longitudinal panels 46*a*, 46*b* can include an acute angle member to insert a respective longitudinal edge of the central panel 40.

One skilled in the art will appreciate that even if the dish assembly 38 has been described and illustrated for a split lid casket, it can easily be applied to a one-piece lid. Even if staples are used as fasteners in the embodiment describe hereinabove, other types of fasteners such as nails or screws or an adhesive can be used. Fasteners such as screws, nails, staples and the like are preferably used with wood caskets.

The dish assembly 38 can be made from cardboards, corrugated or not, chipboard or any other appropriate material. One or both sides of the dish assembly can be covered with a fabric or any other material known by one skilled in the art or can include prints thereon. The central panel, the longitudinal panels and the panels of the header and pie covering assemblies can have a puffy appearance rather than being flat panels.

The longitudinal panels 46*a*, 46*b* and the panels 68, 86, 286 of the header and pie covering assemblies can be pre-shaped into a semi-circular shape or any other predetermined shape. They can also be shape while mounting the dish assembly 38 into the casket lid 14.

The dish assembly can be mounted on a casket lid not including transversal and/or longitudinal rims. In that case, the dish assembly is mounted to the longitudinal sides and transversal ends of the cover. The dish assembly can be mounted on casket lid having a different shape than a curved shape. For example, the casket lid cannot include a pie.

The interior structure or the dish assembly of the invention is easily and conveniently installed so as to present a neat, finished appearance. Few fasteners need to be covered once mounted inwardly of the lid.

The embodiments of the invention described above are intended to be exemplary only. The dish assembly of the invention can only include portions of the dish assembly of the embodiment disclosed hereinabove or can be mounted with only a portion of the method disclosed. The scope of the invention is therefore intended to be limited solely by the scope of the appended claims.

What is claimed is:

1. A casket lid comprising:

a lid member having an underside; and a dish assembly covering at least a first section of the underside of the lid member, the dish assembly including a first flap and a first covering section, the first flap being mounted to the lid member and the first covering section extending over the first flap and the first section of the underside of the lid member, the first flap and the first covering section defining a first cover member of the dish assembly, the dish assembly comprises a second cover member covering a second section of the underside, one of the first cover member and the second cover member including an acute angle member defining an acute angle spacing, an edge of the other one of the first cover member and the second cover member being inserted into the acute angle spacing for assembling the first cover member and the second cover member.

2. A casket lid as claimed in claim 1, comprising fasteners coupling the first flap and the lid member to mount the dish assembly to the lid member, the fasteners being hidden by the first covering section when the first covering section extends over the first section of the underside of the lid member.

3. A casket lid as claimed in claim 1, wherein the second cover member has an outer flap separated from the acute angle member by a covering section, the outer flap being mounted to the lid member, the covering section extending over the outer flap and the second section of the underside of the lid member.

4. A casket lid as claimed in claim 1, wherein the dish assembly comprises a third cover member covering a third section of the underside, the third cover member having an inner flap mounted to one of the first cover member and the second cover member with at least one fastener, a covering section extending over the inner flap and the at least one fastener, and an outer flap mounted to the lid member.

5. A casket lid as claimed in claim 4, wherein the lid member comprises an insertion member defining a longitudinal groove, the outer flap of the third cover member being received in the longitudinal groove.

6. A casket lid as claimed in claim 1, wherein the lid member comprises a cover and a rim at least partly surrounding the cover; the first flap being mounted to the underside of the rim, the first covering section extending over the first flap and at least partially the rim.

7. A casket lid as claimed in claim 6, wherein the first covering section comprises a side panel juxtaposed to the first flap and a central panel juxtaposed to the side panel, the central panel at least partly extending over the cover of the casket lid.

8. A casket lid as claimed in claim 7, comprising fasteners mounting the central panel to the side panel, the fasteners being positioned between the side panel and the underside of the casket lid, hidden by the side panel.

9. A casket comprising the casket lid as claimed in claim 1.

10. A casket lid dish assembly adapted to cover at least one portion of an underside of a casket lid, the casket lid dish assembly comprising: a first cover member having an outer flap securable to the casket lid and a covering section extending over the at least one portion of the underside, the outer flap being hidden behind the covering section and a central panel mounted to an inner flap of the first cover member with the inner flap overlying a section of the central panel and the covering section extending over the assembly formed by the inner flap and the central panel.

11. A casket lid dish assembly as claimed in claim 10, wherein the covering section is contiguous to the outer flap, the junction of the outer flap and the covering section defining a living hinge allowing the outer flap and the covering section to define an acute angle when secured to the casket.

12. A casket lid dish assembly as claimed in claim 10, comprising a second cover member mounted to the central panel and having a covering section and an inner flap, the inner flap overlying a section of the central panel, the covering section of the second cover member extending over an assembly formed by the central panel and the inner flap of the second cover member.

13. A casket lid dish assembly as claimed in claim 10, comprising a second cover member covering a second portion of the underside, one of the first cover member and the second cover member including an acute angle member defining an acute angle spacing, an edge of the other one of the first cover member and the second cover member being inserted into the acute angle spacing for assembling the first cover member and the second cover member.

14. A casket lid comprising:

a lid member having an underside;

a dish assembly having a first panel extending over at least a first section of the underside of the lid member and having a first edge; and an insertion member defining an insertion groove and being positioned on one of the underside of the lid member and a second panel of the dish assembly, the first edge of the first panel being inserted into the insertion groove, the insertion member including an acute angle member extending from a covering section of the second panel and an edge of the second panel is mounted to the underside of the lid member, the covering section of the second panel extending over a section of the underside of the lid member.

15. A casket lid as claimed in claim 14, wherein the insertion member comprises a lip member mounted to the underside of the lid member, a second edge of the first panel is superimposed to a section of the second panel, and a covering section of the first panel, extending between the first and the second edges, extends over the superimposition of the section of the second panel and the second edge of the first panel.

16. A casket lid as claimed in claim 14, comprising a third panel having an outer edge mounted to the underside of the lid member, a covering section extending over the outer edge and a section of the underside of the lid member and an inner edge superimposed to a second edge of the first panel, the covering section of the third panel extending over the superimposition of the inner edge of the third panel and the second edge of the first panel.

17. A casket comprising the casket lid as claimed in claim 14.

18. A casket lid comprising:

a lid member having an underside;

a dish assembly covering at least a first section of the underside of the lid member, the dish assembly including a first flap and a first covering section, the first flap being mounted to the lid member and the first covering section extending over the first flap and the first section of the underside of the lid member; and fasteners coupling the first flap and the lid member to mount the dish assembly to the lid member, the fasteners being hidden by the first covering section when the first covering section extends over the first section of the underside of the lid member.

19. A casket lid as claimed in claim 18, wherein the lid member comprises a cover and a rim at least partly surrounding the cover; the first flap being mounted to the underside of the rim, the first covering section extending over the first flap and at least partially the rim.

20. A casket lid comprising:

a lid member having an underside, a cover and a rim at least partly surrounding the cover; and a dish assembly covering at least a first section of the underside of the lid member, the dish assembly including a first flap and a first covering section, the first flap being mounted to the lid member and the first covering section extending over the first flap and the first section of the underside of the lid member, the first flap being mounted to the underside of the rim, the first covering section extending over the first flap and at least partially the rim.

21. A casket lid as claimed in claim 20, wherein the first covering section comprises a side panel juxtaposed to the first flap and a central panel juxtaposed to the side panel, the central panel at least partly extending over the cover of the casket lid.

22. A casket lid as claimed in claim 21, comprising fasteners mounting the central panel to the side panel, the fasteners being positioned between the side panel and the underside of the casket lid, hidden by the side panel.

23. A casket lid dish assembly adapted to cover at least one portion of an underside of a casket lid, the casket lid dish assembly comprising: a first cover member having an outer flap securable to the casket lid and a covering section extending over the at least one portion of the underside, the outer flap being hidden behind the covering section, the covering section being contiguous to the outer flap, the junction of the outer flap and the covering section defining a living hinge allowing the outer flap and the covering section to define an acute angle when secured to the casket.

24. A casket lid dish assembly as claimed in claim 23, comprising a second cover member covering a second portion of the underside, one of the first cover member and the second cover member including an acute angle member defining an acute angle spacing, an edge of the other one of the first cover member and the second cover member being inserted into the acute angle spacing for assembling the first cover member and the second cover member.

* * * * *